US009301664B1

(12) United States Patent
King, Jr.

(10) Patent No.: US 9,301,664 B1
(45) Date of Patent: Apr. 5, 2016

(54) SYSTEM AND METHOD FOR CAPTURING DUST FROM DEBRIS TRANSPORTATION

(71) Applicant: Jack Marion King, Jr., Phoenix, AZ (US)

(72) Inventor: Jack Marion King, Jr., Phoenix, AZ (US)

(73) Assignee: Skitter & Squirt Adventures, LLC, Missoula, MT (US)

( * ) Notice: Subject to any disclaimer, the term of this patent is extended or adjusted under 35 U.S.C. 154(b) by 673 days.

(21) Appl. No.: 13/691,461

(22) Filed: Nov. 30, 2012

Related U.S. Application Data

(63) Continuation-in-part of application No. 13/086,334, filed on Apr. 13, 2011, now Pat. No. 8,793,835, and a continuation-in-part of application No. 13/309,037, filed on Dec. 1, 2011, and a continuation-in-part of application No. 13/691,408, filed on Nov. 30, 2012, now Pat. No. 8,578,554.

(51) Int. Cl.
*A47L 5/00* (2006.01)
*A47L 7/00* (2006.01)

(52) U.S. Cl.
CPC ..... *A47L 7/00* (2013.01)

(58) Field of Classification Search
CPC ..... A47L 7/00
USPC ..... 15/402
IPC ..... A47L 5/00
See application file for complete search history.

(56) References Cited

U.S. PATENT DOCUMENTS

| | | | | | |
|---|---|---|---|---|---|
| 841,175 | A | * | 1/1907 | Phinney | 132/114 |
| 3,066,683 | A | * | 12/1962 | Pace | 132/148 |
| 3,368,341 | A | | 2/1968 | Goebel | |
| 3,442,337 | A | | 5/1969 | Astrom | |
| 3,611,473 | A | * | 10/1971 | Johnson | 15/397 |
| 3,744,082 | A | | 7/1973 | Marshall et al. | |
| 3,745,604 | A | * | 7/1973 | Fitzwater | 15/397 |
| 3,766,596 | A | * | 10/1973 | Clewett | 15/397 |
| 3,815,171 | A | | 6/1974 | Carr et al. | |
| 3,878,582 | A | | 4/1975 | Hukuba et al. | |
| 3,894,308 | A | | 7/1975 | Carr et al. | |
| 3,895,407 | A | | 7/1975 | Parise | |
| 3,992,748 | A | * | 11/1976 | Howard et al. | 15/397 |
| 4,192,104 | A | | 3/1980 | Patenaude | |
| 4,360,947 | A | | 11/1982 | De Cosa et al. | |
| 4,558,752 | A | | 12/1985 | Freund | |
| 4,747,178 | A | | 5/1988 | Breitzbach | |
| 5,228,244 | A | | 7/1993 | Chu | |
| 5,437,078 | A | | 8/1995 | Courcelles | |
| 5,440,809 | A | | 8/1995 | Padilla | |
| 5,833,524 | A | | 11/1998 | Satoh et al. | |
| 6,017,400 | A | | 1/2000 | Clark et al. | |
| 6,065,633 | A | | 5/2000 | Abbey | |
| 6,079,078 | A | | 6/2000 | Byington | |
| 6,514,131 | B1 | | 2/2003 | Reich et al. | |

(Continued)

*Primary Examiner* — David Redding
(74) *Attorney, Agent, or Firm* — Lisa Foundation Patent Law Clinic at Arizona State University

(57) ABSTRACT

A system and method for capturing dust from debris transportation are disclosed. The system comprises at least one piece of hollow tubing comprising a plurality of air intake passages and configured to transport debris and capture dust when coupled to a negative pressure source, the air intake passages further configured such that an air curtain of suction emanates from the plurality of air intake passages when the negative pressure source is engaged in generating a negative pressure.

6 Claims, 2 Drawing Sheets

(56) References Cited

U.S. PATENT DOCUMENTS

| | | | |
|---|---|---|---|
| 6,641,634 | B2 | 11/2003 | Reich et al. |
| 6,854,937 | B1 | 2/2005 | Weiss |
| 7,281,886 | B2 | 10/2007 | Stoerig |
| 7,740,086 | B2 | 6/2010 | Bleicher et al. |
| 7,784,137 | B2 | 8/2010 | Knopow |
| 7,784,149 | B2 | 8/2010 | Schwarz et al. |
| 7,797,794 | B2 | 9/2010 | Bleicher et al. |
| 2006/0026790 | A1 | 2/2006 | Consilvio |
| 2007/0028416 | A1 | 2/2007 | Dunkel et al. |
| 2007/0193759 | A1 | 8/2007 | Sweig |
| 2010/0242216 | A1 | 9/2010 | MacNaughtan |
| 2010/0243656 | A1 | 9/2010 | Nazarian |
| 2011/0296644 | A1 | 12/2011 | Grassman |

* cited by examiner

SYSTEM AND METHOD FOR CAPTURING DUST FROM DEBRIS TRANSPORTATION

CROSS REFERENCE TO RELATED APPLICATION

This application is a continuation-in-part of and claims priority to U.S. patent application Ser. No. 13/086,334, titled "System and method for capturing resultant dust from power tool operation," and filed on Apr. 13, 2011 by Jack M. King, Jr.; U.S. patent application Ser. No. 13/309,037, titled, "Vacuum device for capturing dust within a receptacle," filed on Dec. 1, 2011 by Jack M. King, Jr; and U.S. patent application Ser. No. 13/691,408 titled, "System and method for capturing dust from power tool operation," filed on Nov. 30, 2012 by Jack M. King, Jr. The contents of the above mentioned applications are hereby incorporated by reference.

BACKGROUND OF THE INVENTION

1. Field of the Invention

The present disclosure relates to debris transport, and more specifically dust capture during debris transport.

2. Description of Related Art

The removal of flooring tile is a dirty and time-consuming process. Power driven chisels are often employed to speed the removal of the tile and its backing adhesive material. However, this process results in a large amount of dust and debris that is ejected into the ambient air. A large amount of preparation time is needed in order to protect surrounding areas from being contaminated with dust, and an equally large amount of time is necessary in order to remove expelled dust from the workspace after the chiseling is complete. The health of those in the area is negatively affected by the dust, and environmental regulations in certain areas prohibit the escape of the removed dust into the atmosphere.

In order to expedite the process of dust and debris removal from a floor surface, a number of tools have been conceived of Generally, many of these apparatuses involve applying a vacuum to a tool with wheels or other rolling means, which then collects contaminants from the floor surface. In other words, the current state of the art is essentially a traditional vacuum cleaner that could be rolled across a dusty surface to collect dust and debris resulting from tile removal, or a hose vacuum that a user could pass over dusty areas to capture dust from the ground. These means of capturing dust in the situation of floor tile removal, where debris is large and dust can be extremely heavy, have several shortcomings. First, in certain of these embodiments, the suction is prone to decreasing over the duration of the job because large tile debris can block the air intake area. Not only can this slow the already time-consuming process, but it can also require the user to frequently clear the air intake area of the device, thus further exposing her to harmful dust in the air. Second, other embodiments in the prior art rely on tools with rake-like tines to apply suction to a dusty floor surface. This approach to capturing dust does not effectively gather dust resultant from an entire room of removed tile, since suction through the tines themselves encourages larger debris to adhere to the air intake area, preventing additional dust from being collected. Third, embodiments in the prior art that rely on wheels or rolling means to travel across a floor surface are ill-suited to the task of dust capture following the process of tile chiseling, since wheel travel would be impeded by large tile debris strewn across the cleaning area.

So as to reduce the complexity and length of the Detailed Specification, and to fully establish the state of the art in certain areas of technology, Applicant herein expressly incorporates by reference all of the following materials identified in each numbered paragraph below.

U.S. Pat. No. 3,878,582 discloses a carpet fluffing, dust-suction device comprising a hollow axle with rows of hollow tines extending outwardly from the axle. Located at each end of the hollow axle are mounted wheels to allow the device to travel across a floor surface.

U.S. Pat. No. 3,895,407 discloses an adapter that can be coupled to a vacuum to clean shag rugs. Suction is applied through rake tines that extend downward to a shag rug floor surface from the coupled vacuum, and dirt is captured from the rug as the adapter is moved across the surface.

U.S. Pat. No. 6,017,400 discloses a method and system for cleaning a water basin floor. Hollow rake tines are coupled to the lower surface of a hood, and the device moves along a water basin floor to capture sediment that can gather over time. The plurality of rake tines ejects pressurized water from a pump to agitate sediment on the floor surface, which is then suctioned into the device.

U.S. application 2006/0026790 discloses a dustpan with on-board vacuum. In its embodiment, a vacuum hose is coupled to the leading edge of a dustpan in order to facilitate capture of a small volume of dust left behind as debris is swept into the dust pan.

U.S. Pat. No. 5,437,078 discloses a dust pan to which a central vacuum hose can be coupled. The device captures dust as it is swept into the dust pan.

U.S. application 2011/0296644 discloses a vacuum cleaner attachment resembling a dustpan. The attachment includes a leading surface onto which dust or debris can be swept, as well as a suction surface comprising a grate of suction holes through which dust can be captured.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant will amend the specification to expressly recite the essential material that is incorporated by reference as allowed by the applicable rules.

BRIEF SUMMARY OF THE INVENTION

The present invention provides among other things a device for capturing resultant dust from debris transportation. In one embodiment, the device comprises hollow tubing comprising a plurality of air intake passages. The device is configured to transport debris and capture dust when coupled to a negative pressure source. The plurality of air intake passages can be configured such that an air curtain of suction emanates from the plurality of air intake passages when the negative pressure source is engaged in generating a negative air pressure.

In one embodiment, the device includes at least one piece of hollow tubing, to which is coupled a plurality of tines.

In one embodiment, the plurality of air intake passages is arranged in a row along the hollow tubing.

In one embodiment, the device includes a hollow shaft coupled at one end to a negative pressure source, and at another end coupled perpendicularly to a hollow cross-member. The hollow cross-member comprises a plurality of air intake passages and a plurality of tines.

In one embodiment, the plurality of tines is coupled directly to the cross-member.

In one embodiment, the plurality of tines is coupled to the cross-member using a plurality of extender nuts.

In one embodiment, a reinforcement member is coupled to the hollow shaft and hollow cross-member to support the device structure.

In one embodiment, the tines are comprised of a metal.

In one embodiment, the tines are comprised of a metalloid.

In one embodiment, the tines are comprised of an alloy.

In one embodiment, the tines are comprised of a plastic.

In one embodiment, the tines are comprised of an aluminum.

In one embodiment, the tines are comprised of a wood.

In one embodiment, the air intake passages have an elliptical shape.

In one embodiment, the plurality of tines is arranged in a row along the hollow cross-member.

In one embodiment, the plurality of air intake passages is arranged in a row along the hollow cross-member.

In one embodiment, the device includes a plurality of hollow tubes, each comprising a plurality of air intake passages and configured to align with the rim of a shovel, except for a leading edge of a shovel blade, and an exit passage coupled to the plurality of hollow tubes and to a negative pressure source.

In one embodiment, the plurality of tines is coupled to the plurality of hollow tubes such that each of the plurality of tines extends over an upper surface of a shovel blade when the device is coupled to a shovel.

In one embodiment, the plurality of tines is coupled directly to the plurality of hollow tubes.

In one embodiment, the plurality of tines is coupled to the plurality of tubes using a plurality of extender nuts.

In one embodiment, a hinge is coupled to the exit passage and configured to allow the exit passage to be coupled to a handle of a shovel.

In one embodiment, a fastener is used to couple the exit passage to a handle of a shovel.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

The prior art discussed above generally offers unsustainable or impracticable methods of capturing large amounts of dust from the air while sorting through debris. This invention offers a novel method of managing larger debris while effectively preventing agitated dust from becoming dispersed into the air following the process of chiseling tile. In this way, the present invention is more effective, requires less frequent intervention by a user, and reduces potentially harmful exposure to dust by a user.

Figures 1, 2, 3:
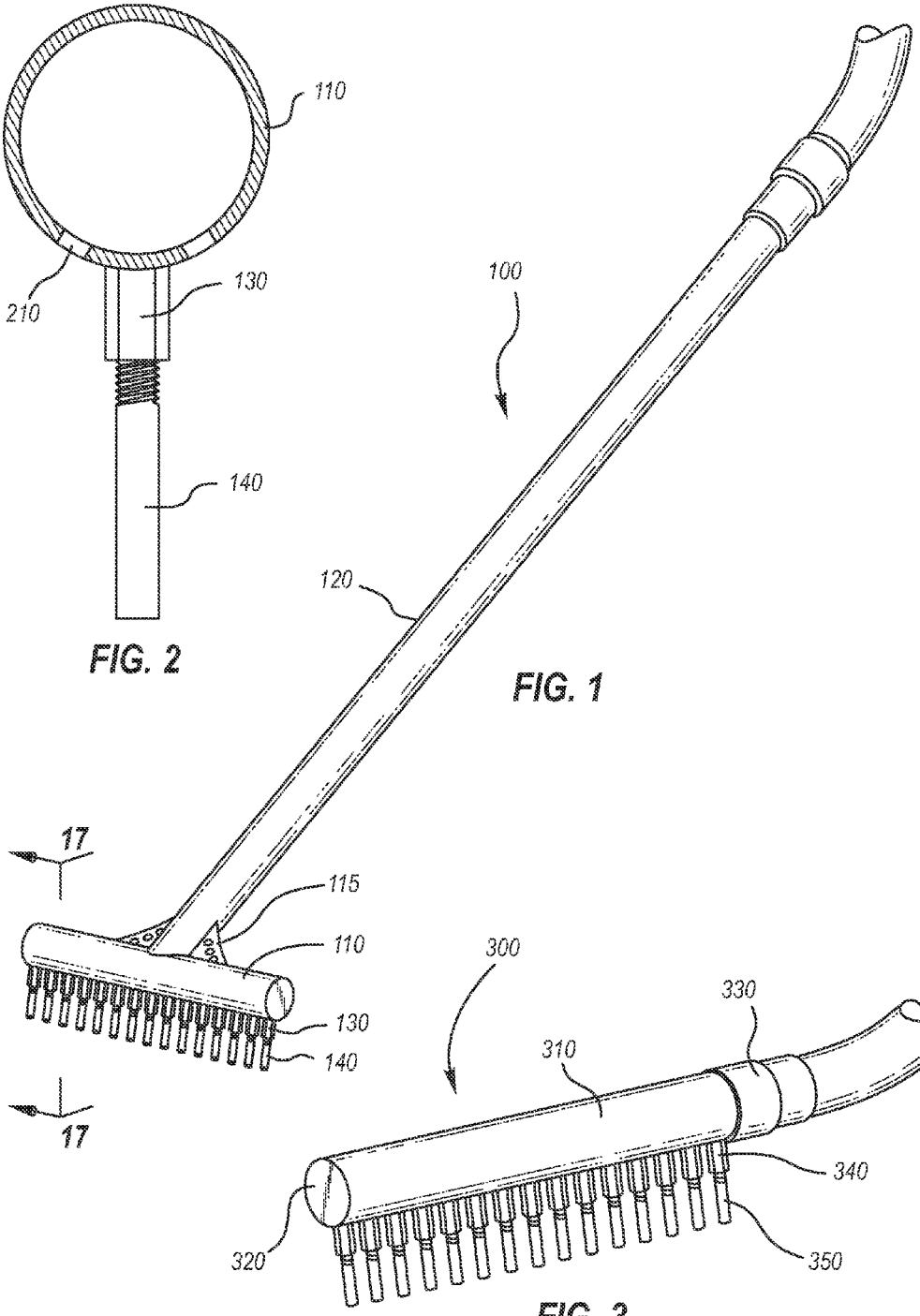
FIG. 1 depicts a perspective view of an embodiment of the invention.
FIG. 2 depicts a cross-sectional view of an embodiment of the invention.
FIG. 3 depicts a perspective view of a handheld embodiment of the invention.

Referring to FIG. 1, a perspective view of a device for collecting dust during transport of debris 100 is shown. According to this embodiment of the invention, the device 100 can comprise a hollow cross-member 110 coupled to a first end of a hollow shaft 120 such that their interior volumes are fluidly coupled. In one embodiment, coupling of the hollow cross-member 110 and the hollow shaft 120 is reinforced using at least one reinforcement member 115. The hollow shaft 120 can be coupled at a second end to a negative pressure source in order to create negative pressure through the device 100. The hollow cross-member 110 can comprise a plurality of air intake passages 210 through which air can be drawn when a negative pressure source is coupled to a second end of the hollow shaft 120. Depending on the application and type of dust involved, the plurality of air intake passages 210 can be comprised of elliptical, rectangular, or irregular shapes and can be made larger or smaller to capture particulate dust of different sizes. The hollow cross-member 110 can further comprise a plurality of extender nuts 130 coupled to the hollow cross-member 110. A plurality of tines 140 can be coupled to the plurality of extender nuts 130 in order to prevent debris from obstructing the air intake passages 210 when the device 100 is in use. In another embodiment, a plurality of tines 140 can be coupled to the hollow cross-member 110. The tines 140 of the device 100 can be comprised of a variety of materials including metals, metalloids, alloys, woods, and plastics. Although the plurality of tines 140 can be coupled to the hollow cross-member 110 at any angle, in a preferred embodiment the plurality of tines 140 are coupled to the hollow cross-member in a substantially straight row such that theoretical lines extending along the length of at least one of the tines 140 and the hollow shaft 120 create an obtuse angle. This position facilitates effective debris transport by the plurality of tines 140 and dust capture through the plurality of air intake passages 210 while the user holds the hollow shaft 120.

Referring to FIG. 2, a cross-sectional view of the embodiment in FIG. 1 is shown. In this view, the embodiment can have multiple rows of air intake passages 210. Alternatively, the air intake passages 210 can be arranged in a single row in relation to a plurality of extender nuts 130 or tines 140. The plurality of extender nuts 130 can be coupled to the outer surface of the hollow cross-member 110. In order to provide raking functionality to the device 100, a plurality of tines 140 can be coupled to the extender nuts 130 or to the outer surface of the hollow cross-member 110.

Referring to FIG. 3, a perspective view of a handheld device for collecting dust during transport of debris 300 is illustrated according to an embodiment of the invention. The device 300 is comprised of a single piece of hollow exhaust tubing 310, which can have a closed first end 320. In order to create suction through the device 300, a negative pressure source can be coupled to an open second end 330 of the hollow exhaust tubing 310. The device 300 can be wielded by a user by holding the hollow exhaust tubing 310 or by holding the point of coupling of the hollow exhaust tubing 310 to a negative pressure source. A plurality of extender nuts 340 can be coupled to the outer surface of hollow exhaust tubing 310 in order to facilitate coupling of a plurality of tines 350 to the hollow exhaust tubing 310. The hollow exhaust tubing 310 can also comprise a plurality of air intake passages (not shown) which allows the collection of dust during transport of debris.

Figure 4:
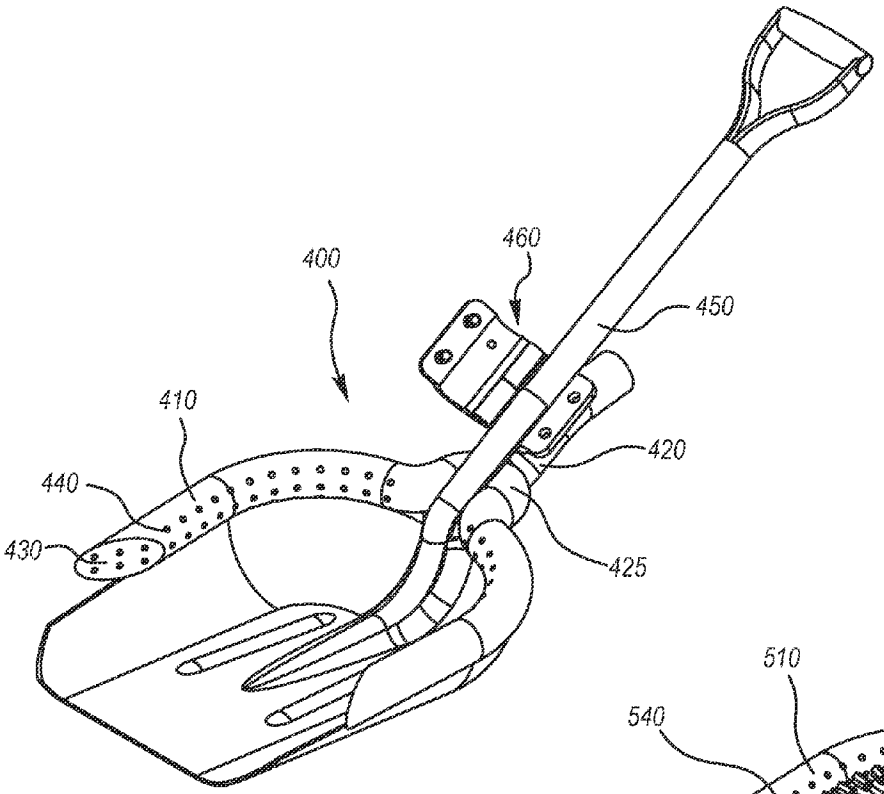
FIG. 4 depicts a perspective view of a device coupled to a shovel according to an embodiment of the invention.

Referring to FIG. 4, a perspective view of a device for collecting dust during transport of debris 400 is illustrated according to an embodiment of the invention. The device 400 has at least two pieces of hollow exhaust tubing 410 coupled to form a single hollow exit tube 420 whose interior volume is fluidly coupled to the interior volumes of the two pieces of hollow exhaust tubing 410. The point at which the hollow exhaust tubing 410 and the single hollow exit tube 420 are coupled 425 can be configured in order to allow adjustment of the positioning of the pieces of hollow exhaust tubing 410 relative to one another. Each piece of hollow exhaust tubing can comprise a first end 430 which is substantially closed. The substantially closed first end 430 of each piece of hollow exhaust tubing 410 can be oriented in any direction, but is preferably such that the angle of each substantially closed first end 430 facilitates funneling of debris into the area between the hollow exhaust tubing 410. Each piece of hollow exhaust tubing 410 can further comprise a plurality of air intake passages 440 along its length. The air intake passages 440 can also be located on the substantially closed first end 430 of each piece of hollow exhaust tubing 410 in order to improve suction. In order to facilitate use of the dust collection device 400 with a shovel 450, a point of attachment 460 can be located on the device 400 that allows the at least two pieces of hollow exhaust tubing 410 to be securely attached to a shovel 450. The point of attachment 460 can be a hinge which couples to the handle of a shovel 450.

Figure 5:
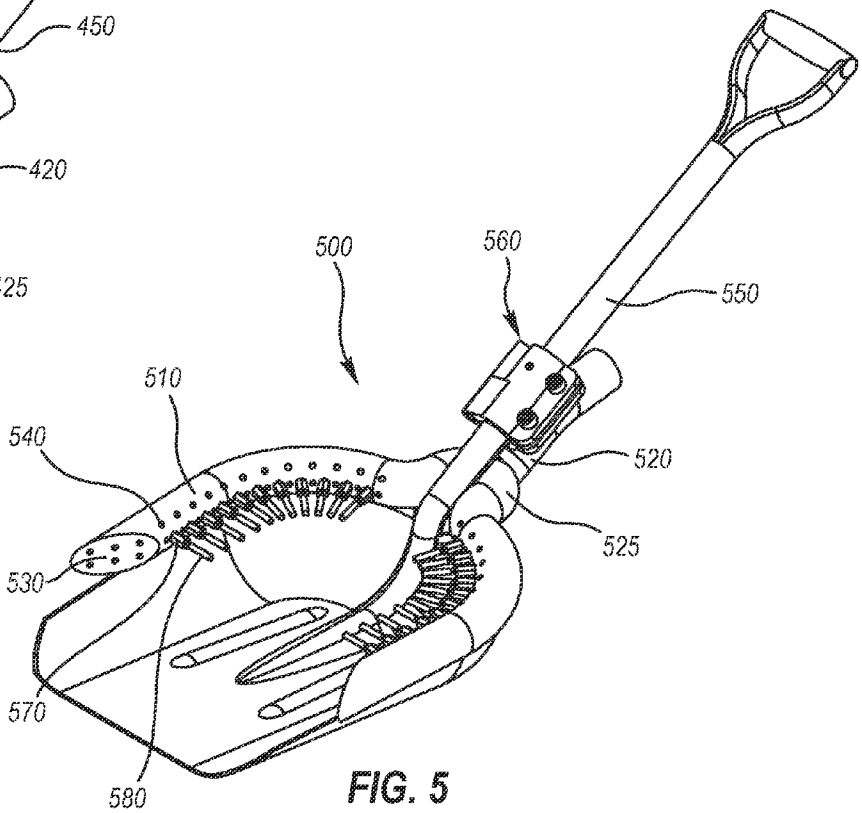
FIG. 5 depicts a perspective view of a device comprising rake tines coupled to a shovel according to an embodiment of the invention.

Referring to FIG. 5, a perspective view of an additional embodiment of a device for collecting dust during transport of debris 500 is shown. This embodiment of the invention can be substantially similar to the embodiment shown in FIG. 4, and can comprise hollow exhaust tubing 510, a single hollow exit tube 520, adjustable coupling point 525, a first end of each piece of hollow tubing 530, a plurality of air intake passages 540, a shovel 550, and a point of attachment 560. Further, this embodiment can comprise a plurality of extender nuts 570 coupled to the plurality of hollow exhaust tubing 510. A plurality of tines 580 can be coupled to the plurality of extender nuts 570 in order to prevent larger debris from obstructing air flow through the air intake passages 540. In another embodiment, a plurality of tines 580 can be coupled to the outer surface of the hollow exhaust tubing 510.

I claim:

1. A dust removal device, comprising:

a plurality of tubes, each comprising a hollow interior, a plurality of air intake passages, and a first end, and configured to align with the rim of a shovel blade; and an exit passage comprised of a hollow interior coupled at a first end to a negative pressure source and at a second end of each of the plurality of tubes such that the hollow interior of the exit passage is fluidly coupled to the hollow interior of each of the plurality of tubes.

2. The dust removal device of claim 1, wherein a plurality of tines is coupled to the plurality of tubes such that each of the plurality of tines extends over an upper surface of a shovel blade when the devices is coupled to a shovel.

3. The dust removal device of claim 2, wherein the plurality of tines is coupled to the plurality of tubes using a plurality of extender nuts.

4. The dust removal device of claim 2, wherein the plurality of tines is comprised of at least one of a metal, a metalloid, an alloy, a plastic, an aluminum, and a wood.

5. The dust removal device of claim 1, wherein the plurality of air intake passages is arranged in at least one row extending longitudinally along each of the plurality of tubes.

6. The dust removal device of claim 1, wherein a hinge is coupled to the exit passage and configured to allow the exit passage to be coupled to a handle of a shovel.

* * * * *